US009743780B2

(12) United States Patent
Mohr

(10) Patent No.: US 9,743,780 B2
(45) Date of Patent: Aug. 29, 2017

(54) INFANT ENCLOSURE

(71) Applicant: Lizzette F. Mohr, St. Johns, FL (US)

(72) Inventor: Lizzette F. Mohr, St. Johns, FL (US)

(73) Assignee: Mumbelli Group LLC, St. Johns, FL (US)

( * ) Notice: Subject to any disclaimer, the term of this patent is extended or adjusted under 35 U.S.C. 154(b) by 0 days.

(21) Appl. No.: 15/384,795

(22) Filed: Dec. 20, 2016

(65) Prior Publication Data

US 2017/0172312 A1 Jun. 22, 2017

Related U.S. Application Data

(60) Provisional application No. 62/270,144, filed on Dec. 21, 2015.

(51) Int. Cl.

| | |
|---|---|
| ***A47D 13/02*** | (2006.01) |
| ***A47D 15/00*** | (2006.01) |
| ***A47D 7/01*** | (2006.01) |
| ***A47D 9/00*** | (2006.01) |

(52) U.S. Cl.

CPC ..... *A47D 15/001* (2013.01); *A47D 7/01* (2013.01); *A47D 9/00* (2013.01)

(58) Field of Classification Search

CPC ..... A47D 13/00; A47D 13/02

USPC ..... 5/655, 632, 640, 657

See application file for complete search history.

(56) References Cited

U.S. PATENT DOCUMENTS

| | | | | |
|---|---|---|---|---|
| 3,583,765 | A * | 6/1971 | Wallis | A47D 5/00 297/153 |
| 3,761,975 | A | 10/1973 | Personett | |
| 3,993,042 | A | 11/1976 | Gatts | |
| 4,606,087 | A | 8/1986 | Alivizatos | |
| 4,667,356 | A | 5/1987 | Holmquist | |
| 4,698,862 | A | 10/1987 | Mairs | |
| 4,761,032 | A | 8/1988 | Sanchez et al. | |
| 4,802,244 | A | 2/1989 | McGrath-Saleh | |
| 4,890,346 | A | 1/1990 | Rist | |
| 4,947,832 | A | 8/1990 | Blitzer | |
| 4,980,937 | A * | 1/1991 | Mason | A47D 13/08 5/655 |
| 5,005,902 | A | 4/1991 | Farnworth et al. | |
| 5,014,376 | A | 5/1991 | Doran et al. | |
| 5,231,133 | A * | 7/1993 | Hirasawa | C08K 5/17 525/113 |

(Continued)

FOREIGN PATENT DOCUMENTS

| | | | |
|---|---|---|---|
| CN | 203153167 | U | 8/2013 |
| GB | 2309161 | A | 7/1997 |
| WO | 97/43929 | A1 | 11/1997 |

*Primary Examiner* — Frederick Conley

(57) ABSTRACT

An infant enclosure is provided. The infant enclosure includes a base and a sidewall. Each of the base and the sidewall are made of a compressible padded material. The sidewall extends vertically from the base, forming an oval shape. The sidewall includes a first connector attached a first side of an inner surface of the sidewall and a second connector attached to an opposing second side of an inner surface of the sidewall. The infant enclosure further includes a foot insert. The foot insert includes an elongated body made of the compressible padded material. The foot insert is releasably secured within the sidewall. The foot insert applies a small amount of pressure against the infant, simulating the infant being within a womb.

8 Claims, 3 Drawing Sheets

(56) References Cited

U.S. PATENT DOCUMENTS

| | | | | |
|---|---|---|---|---|
| 5,261,133 | A | 11/1993 | Wilkerson | |
| 5,293,655 | A | 3/1994 | VanWinkle et al. | |
| 5,329,934 | A | 7/1994 | Bowman | |
| RE34,763 | E | 10/1994 | Tucker | |
| 5,387,177 | A | 2/1995 | Dunn | |
| 5,392,785 | A | 2/1995 | Donahue | |
| 5,411,457 | A | 5/1995 | Hartdegen, III et al. | |
| 5,439,008 | A | 8/1995 | Bowman | |
| 5,524,640 | A * | 6/1996 | Lisak | A47D 13/08 128/869 |
| 5,553,337 | A | 9/1996 | Lin | |
| 5,581,833 | A | 12/1996 | Zenoff | |
| 5,699,569 | A | 12/1997 | Schwarz-Zohrer | |
| 5,800,368 | A | 9/1998 | Klingemann et al. | |
| 5,819,341 | A | 10/1998 | Simantob et al. | |
| 5,979,981 | A | 11/1999 | Dunne et al. | |
| 6,012,189 | A | 1/2000 | Dudley | |
| 6,213,362 | B1 | 4/2001 | Lorenzini et al. | |
| 6,256,965 | B1 | 7/2001 | Sheridan | |
| 6,263,526 | B1 | 7/2001 | Tu | |
| 6,922,861 | B1 | 8/2005 | Mathis | |
| 6,954,955 | B2 | 10/2005 | Brewin et al. | |
| 7,059,000 | B2 | 6/2006 | Verbovszky | |
| 7,107,639 | B2 | 9/2006 | Taricani | |
| 7,445,281 | B2 | 11/2008 | Kassai | |
| 7,500,278 | B2 | 3/2009 | Leach | |
| 7,694,362 | B2 | 4/2010 | Gudipati | |
| 7,703,159 | B2 | 4/2010 | Parrilla | |
| 7,818,832 | B2 | 10/2010 | Hartenstine et al. | |
| 8,112,835 | B2 | 2/2012 | Eirich et al. | |
| 8,127,385 | B1 | 3/2012 | Goutevenier | |
| 8,555,429 | B2 | 10/2013 | Leach | |
| 8,914,927 | B1 * | 12/2014 | Leach | A47D 11/007 5/417 |
| 9,138,072 | B1 | 9/2015 | Sanders et al. | |
| 9,554,659 | B2 | 1/2017 | Doering et al. | |
| 2004/0045088 | A1 | 3/2004 | Borromeo | |
| 2005/0210594 | A1 | 9/2005 | Pistiolis et al. | |
| 2005/0269849 | A1 | 12/2005 | Mathis et al. | |
| 2007/0278264 | A1 | 12/2007 | Chesal et al. | |
| 2008/0149674 | A1 | 6/2008 | Hiniduma-Lokuge | |
| 2010/0187268 | A1 | 7/2010 | Rosen et al. | |
| 2013/0111661 | A1 | 5/2013 | Furuland | |
| 2016/0051430 | A1 | 2/2016 | Bader | |

* cited by examiner

INFANT ENCLOSURE

CROSS-REFERENCE TO RELATED APPLICATION

This application claims the benefit of priority of U.S. provisional application No. 62/270,144, filed Dec. 21, 2015, the contents of which are herein incorporated by reference.

BACKGROUND OF THE INVENTION

The present invention relates to an infant enclosure and, more particularly, to an infant enclosure that mimics a womb.

Some infants experience emotional distress due to their new surroundings outside of the womb. Current baby beds include cribs, bassinets and pack and plays, which do not simulate a comforting, womb-like environment.

As can be seen, there is a need for an improved baby enclosure that mimics a womb.

SUMMARY OF THE INVENTION

In one aspect of the present invention, an infant enclosure comprises: a base comprising a compressible padded material; a sidewall extending vertically from the base and comprising the compressible padded material, wherein the sidewall comprises a first connector attached a first side of an inner surface of the sidewall and a second connector attached to a second side of an inner surface of the sidewall, wherein the second side is opposite the first side; and a foot insert comprising an elongated body and the compressible padded material, wherein a third connector is attached to a first end of the elongated body and a fourth connector is attached to a second end of the elongated body, wherein the foot insert is releasably secured within the sidewall by the third connector releasably attaching to the first connector and the fourth connector is releasably attaching to the second connector.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a portable environment designed to comfort infants and simulate the sensations of the mother's womb. This is achieved by encircling the infant and applying a light pressure against the head and feet. The padding can be adjusted as the baby grows, allowing it to be used longer than one-size-fits-all products. The present invention includes an enclosure and a mattress pad. The mattress pad is placed into the enclosure and a padded adjustable foot insert is attached to the interior sides of enclosure. The enclosure may be an oval shape built out of dense foam, with sidewalls that may be about 6" high. The dense foam may be covered with 100% washable cotton fabric. The base of the enclosure may also be built out of the washable cotton fabric. The enclosure's oval shape mimics the mother's womb. The mattress pad may be built with medium soft foam and covered with the washable cotton fabric, non-permeable, washable fabric. The mattress pad fits inside the enclosure to allow the baby to lay in a comfortable position on their back. The padded adjustable insert is built from soft foam and is attached and adjusted to the desired size, ensuring the baby's feet gently touch it.

Figure 1:
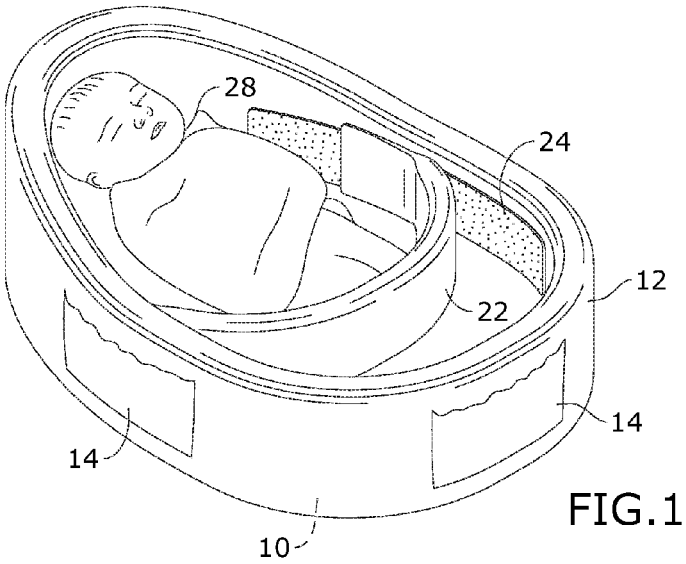
FIG. 1 is a perspective view of an embodiment of the present invention shown in use.
Figure 2:
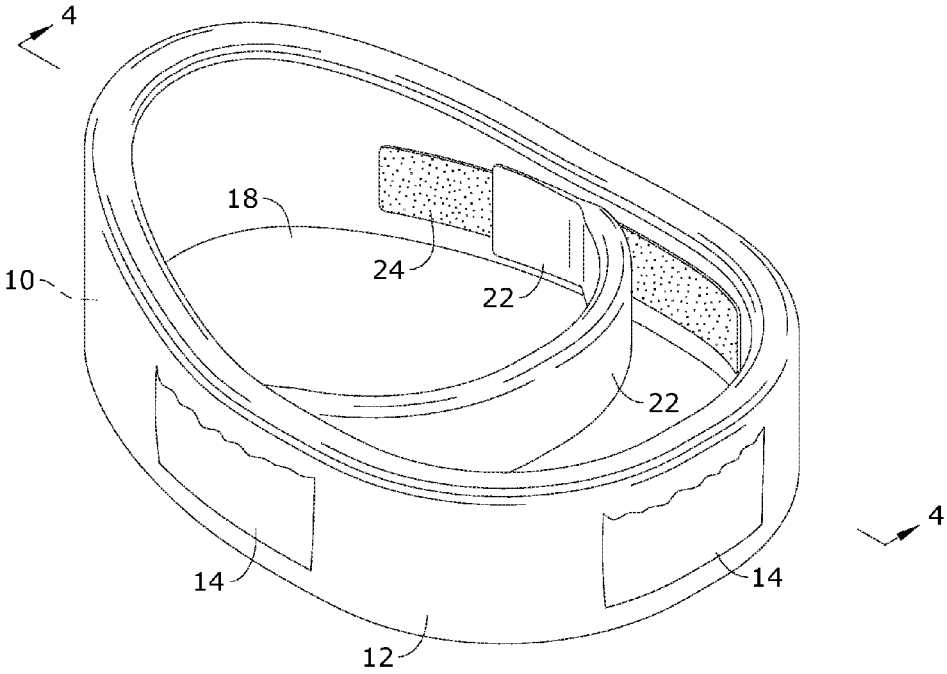
FIG. 2 is a perspective view of the present invention with the foot insert installed in an exemplary position.
Figure 3:
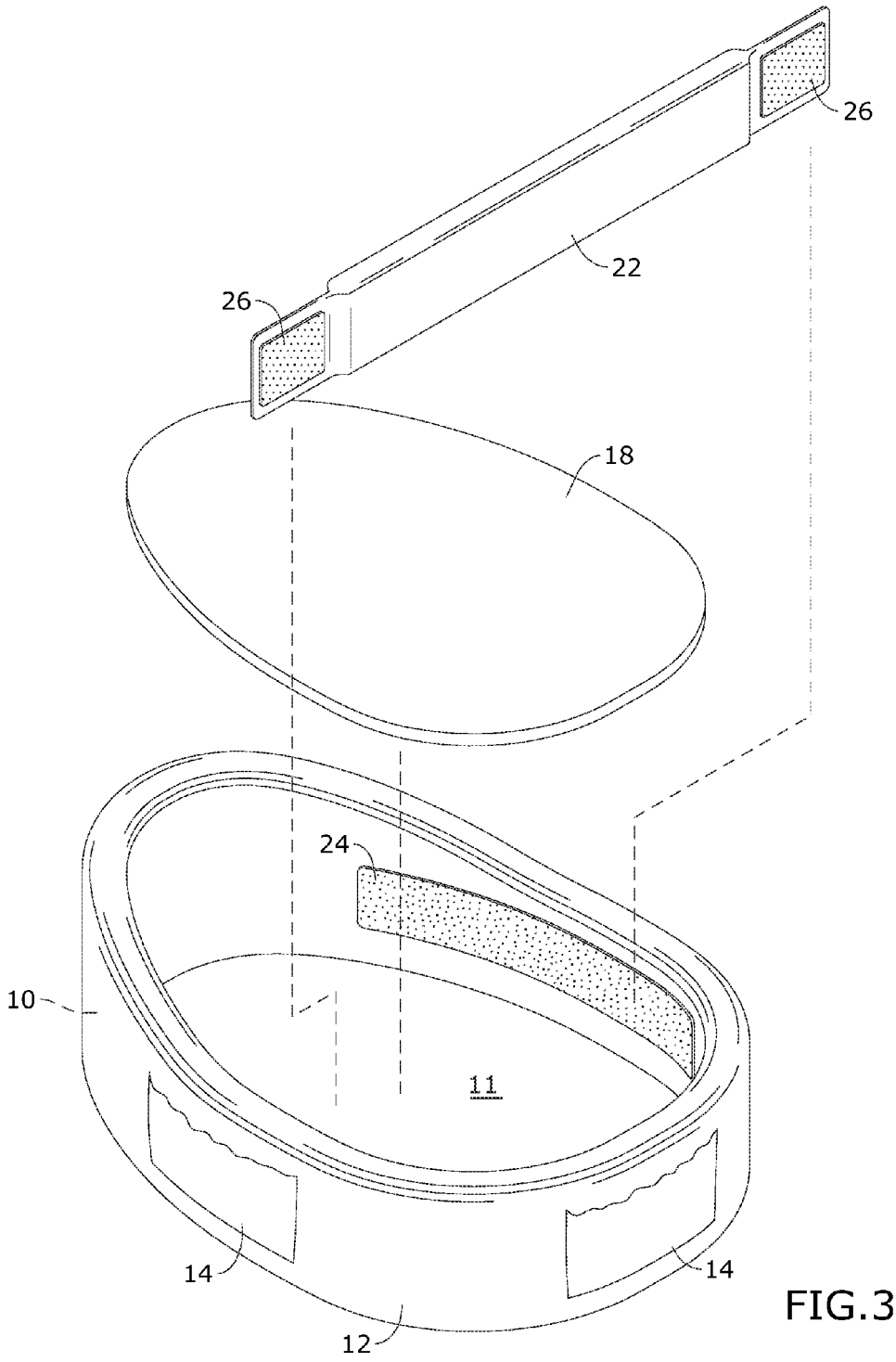
FIG. 3 is an exploded view of an embodiment of the present invention.
Figure 4:
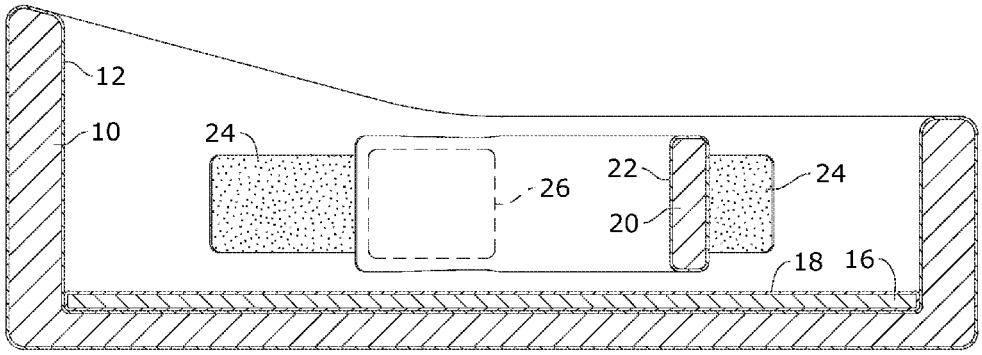
FIG. 4 is a section view of an embodiment of the present invention taken along line 4-4 in FIG. 2.

Referring to FIGS. 1 through 4, the present invention includes an infant enclosure. The infant enclosure includes a base 11 and a sidewall 10. Each of the base 11 and the sidewall 11 are made of a compressible padded material. For example, the sidewall 11 may be made of a dense foam and the base 11 may be made of a less dense softer foam. The sidewall 10 extends vertically from the base 11, forming an oval shape. The sidewall 10 includes a first connector 24 attached to a first side of an inner surface of the sidewall 10 and a second connector 24 attached to an opposing second side of an inner surface of the sidewall 10.

The infant enclosure further includes a foot insert 20. The foot insert 20 includes an elongated body made of the compressible padded material, such as a softer foam. A third connector 26 is attached to a first end of the elongated body and a fourth connector 26 is attached to a second end of the elongated body. The foot insert 20 is releasably secured within the sidewall 10 by the third connector 26 releasably attaching to the first connector 24 and the fourth connector 26 releasably attaching to the second connector 24. An infant 28 is placed in between the sidewall 10 and the foot insert 20. The foot insert 20 applies a small amount of pressure against the infant 28, simulating the infant 28 being within a womb.

The present invention may further include a mattress pad 16. The mattress pad 16 may also be made of a compressible padded material, such as a foam material. The mattress pad 16 may be inserted and removed from the infant enclosure. In such embodiments, the mattress pad 16 may include an oval shape and may fit in between the sidewall 10 and rest on the base 11.

In certain embodiments, the base 11 and the sidewall 10 may include an outer fabric layer 12. The outer fabric layer 12 may cover the base 11 and the sidewall 10. The outer fabric layer 12 may be made of a soft material, such as cotton and polyester. In certain embodiments, the mattress pad 16 may include an outer fabric layer 18. In certain embodiments, the foot insert 20 may include an outer fabric layer 22. The outer fabric layer 18 of the mattress pad 16 may be made of a non-permeable water resistant material.

The connectors 24, 26 of the present invention may include clips, magnets, hook and loop fasteners and the like. In certain embodiments, the foot insert 20 may be releasably attached at different positions along the length of the sides of the sidewall 10. This allows a user to adjust the distance from the foot insert 20 and a front end of the sidewall 10 to adjust for a growing infant 28. In such embodiments, the first connector 24 and the second connector 24 may each include an elongated sheet of hook and loop fastener. The third connector 26 and fourth connector 26 may each include a patch of hook and loop fastener releasably attachable to the elongated sheet of hook and loop fastener. Therefore, the third and fourth connectors 26 may be attached to different positions along first and second connectors 26, adjusting the distance between the foot insert 20 and the front end of the sidewall 10.

The present invention may have additional accessories. For example, the present invention may include a 35 degree foam wedge to be placed under the mattress pad 16 to avoid gastro-esophageal reflux. The present invention may further include pockets 14 disposed on an outer surface of the sidewall 10 for storage on the exterior sides of enclosure. The present invention may further include an auxiliary plug and speakers to add audio capabilities.

A method of using the present invention may include the following. The first step is placing the mattress pad 16 into the enclosure. The second step is swaddling the infant 28, and then placing the infant 28 on the mattress pad 16. The third step is adding the foot insert 22 inside the enclosure, and then adjusting the insert 22 so that the foot insert 22 fits snugly against the bottom of the infant's feet.

It should be understood, of course, that the foregoing relates to exemplary embodiments of the invention and that modifications may be made without departing from the spirit and scope of the invention as set forth in the following claims.

What is claimed is:

1. An infant enclosure comprising:

a base comprising a compressible padded material;

a sidewall extending vertically from the base and comprising the compressible padded material, wherein the sidewall comprises a first connector attached a first side of an inner surface of the sidewall and a second connector attached to a second side of an inner surface of the sidewall, wherein the second side is opposite the first side; and a foot insert comprising an elongated body and the compressible padded material, wherein a third connector is attached to a first end of the elongated body and a fourth connector is attached to a second end of the elongated body, wherein the foot insert is releasably secured within the sidewall by the third connector releasably attaching to the first connector and the fourth connector is releasably attaching to the second connector.

2. The infant enclosure of claim 1, wherein the sidewall comprises an oval shape.

3. The infant enclosure of claim 1, further comprising an outer fabric layer covering the base and the sidewall.

4. The infant enclosure of claim 1, further comprising a mattress pad disposed in between the sidewall and resting on the base.

5. The infant enclosure of claim 4, further comprising an outer fabric layer covering the mattress pad.

6. The infant enclosure of claim 1, further comprising at least one pocket formed on an outer surface of the sidewall.

7. The infant enclosure of claim 1, wherein the first connector and the second connector each comprise an elongated sheet of hook and loop fastener, and the third connector and fourth connector each comprise a patch of hook and loop fastener releasably attachable to the elongated sheet of hook and loop fastener.

8. The infant enclosure of claim 1, wherein the compressible padded material is a foam.

* * * * *